US006626811B2

(12) United States Patent
Leijon

(10) Patent No.: US 6,626,811 B2
(45) Date of Patent: Sep. 30, 2003

(54) METHOD AND MACHINE FOR WORKING AN ELONGATE WEB OF MATERIAL

(75) Inventor: Thomas Leijon, Ystad (SE)

(73) Assignee: FAS Converting Machinery AB, Ystad (SE)

( * ) Notice: Subject to any disclaimer, the term of this patent is extended or adjusted under 35 U.S.C. 154(b) by 106 days.

(21) Appl. No.: 09/809,311

(22) Filed: Mar. 16, 2001

(65) Prior Publication Data

US 2001/0023228 A1 Sep. 20, 2001

(30) Foreign Application Priority Data

Mar. 16, 2000 (SE) ..... 0000861

(51) Int. Cl.[7] ..... B31B 1/14; B31B 1/24; B31B 27/14

(52) U.S. Cl. ..... 493/230; 493/233; 493/238; 493/370; 493/926

(58) Field of Search ..... 493/196, 201, 493/230, 233, 238, 240, 243, 322, 341, 362, 370, 371, 267, 926, 194, 199; 83/346, 509, 659; 156/204, 227, 251, 252, 256, 267, 269, 290, 292, 308.4

(56) References Cited

U.S. PATENT DOCUMENTS

| | | | | |
|---|---|---|---|---|
| 4,065,344 A | | 12/1977 | Weist | |
| 4,164,170 A | | 8/1979 | Nordin | |
| 4,308,021 A | | 12/1981 | Achelpohl | |
| 4,332,578 A | | 6/1982 | van der Meulen | |
| 4,368,051 A | * | 1/1983 | Lehmacher | 493/11 |
| 4,537,588 A | | 8/1985 | Ehlscheid et al. | |
| 4,545,844 A | | 10/1985 | Buchanan | |
| 4,599,926 A | | 7/1986 | Carlson, Jr. et al. | |
| 4,636,191 A | | 1/1987 | Piggott | |
| 4,642,084 A | | 2/1987 | Gietman, Jr. | |
| 4,726,804 A | | 2/1988 | Stitcher | |
| 4,767,393 A | | 8/1988 | Smith | |
| 4,846,030 A | | 7/1989 | McMahon et al. | |
| 4,950,217 A | | 8/1990 | Stenqvist | |
| 5,111,725 A | | 5/1992 | Simpson et al. | |
| 5,429,577 A | | 7/1995 | Simpson et al. | |
| 5,555,786 A | | 9/1996 | Fuller | |
| 5,573,489 A | * | 11/1996 | Letendre et al. | 383/8 |
| 5,935,367 A | * | 8/1999 | Hollenbeck | 156/204 |

FOREIGN PATENT DOCUMENTS

| | | |
|---|---|---|
| DE | 3238952 | 4/1984 |
| DE | 3609176 | 10/1987 |
| EP | 0377416 | 7/1990 |
| EP | 0847851 | 6/1998 |
| GB | 2 114 504 | 10/1981 |

OTHER PUBLICATIONS fas converting machinery, see the catalog (Series C).*
PCT International—Type Search Report (PCT/ISA/210).
CF Series, FAS Converting Machinery AB, Estimated publishing date: late eighties.
FC Series, FAS Converting Machinery AB, Estimated publishing date: late eighties.

* cited by examiner

*Primary Examiner*—Rinaldi I. Rada
*Assistant Examiner*—Hemant M. Desai
(74) *Attorney, Agent, or Firm*—Smith, Gambrell & Russell

(57) ABSTRACT

In a method for working an elongate web of material, use is made of a machine which comprises a feeding device for feeding the web at a given speed and a cutting device for making cuts in the web. The cutting device comprises a rotary backing roll and a rotary cutting roll with a projecting cutting means. The cutting roll is adapted to move, during a first part of its revolution, the cutting means into engagement with the backing roll to form the cuts in the web and, during a second part of its revolution, define with the backing roll a gap through which the web moves essentially unimpededly. A control means is adapted to control, preferably in an infinitely variable manner, the speed of rotation of the cutting roll relative to the speed of the web during the second part of the revolution for optional adjustment of the distance between succeeding cuts in the web.

35 Claims, 3 Drawing Sheets

METHOD AND MACHINE FOR WORKING AN ELONGATE WEB OF MATERIAL

FIELD OF THE INVENTION

The present invention relates generally to working of elongate webs of material, and in particular production of cuts in a web of plastic material. The invention is specifically, but not exclusively, aimed at production of plastic bags, especially plastic bags with handles.

BACKGROUND ART

A bag-making machine for producing plastic bags with handles is disclosed in EP-A2-0 847 851. In this bag-making machine, a tubular plastic web is passed through a number of working devices which by turns fold the web, provide the web with weld and perforation lines, provide the web with cuts forming the handles, and finally punch the web for removing web material cut out at the handles.

The cutting device which provides the web with handle cuts comprises a backing roll rotating counter-clockwise and a cutting roll rotating clockwise. The cutting roll has a cutting edge projecting from its circumferential surface and extending over essentially half the circumference of the cutting roll. The web is received between the backing roll and the cutting roll, and the cutting edge of the cutting roll abuts against the backing roll during part of each revolution to form a handle cut in the web. The radii of the backing roll and the cutting roll are selected in such a manner that their peripheral speeds correspond to the web feeding speed through the bag-making machine. In other words, the web moves a bag length for each revolution of the cutting roll and the backing roll. This prior-art bag-making machine is thus designed for production of plastic bags with a given bag length, and extensive modifications of the machine are necessary if longer or shorter bags are to be produced. Another problem of this machine is that there is a risk of cut-out web material coming loose even in the cutting device. Uncontrolled spreading of such material in the machine can result in operating troubles or machine breakdown.

Corresponding cutting devices are also known in envelope-producing machines and the like, such as U.S. Pat. No. 4,537,588,U.S. Pat. No. 4,599,926, U.S. Pat. No. 4,726,804 and U.S. Pat. No. 5,555,786.

SUMMARY OF THE INVENTION

An object of the invention is to wholly or partly obviate the above problems of prior art. More specifically, one object is to provide a method and a machine which are capable of making cuts in an arbitrary spaced-apart relationship in an elongate web of material.

A further object is to provide a method and a machine which allow a high production rate.

One more object is to permit continuous feeding of the web of material.

It is also an object to enable controlled removal of the cut-out material from the web.

Another object is to provide a simple technique of making continuous cuts as well as perforation lines in an elongate web of material.

These and other objects that will be evident from the following description are now at least partly achieved by a method for working an elongate web, preferably of plastic material, the web being fed at a given speed between a rotary backing roll and a rotary cutting roll which has a projecting cutting means, the cutting roll moving, during a first part of its revolution, the cutting means into engagement with the backing roll to form cuts in the web, and the cutting roll defining, during a second part of its revolution, with the backing roll a gap through which the web is moved essentially unimpededly, wherein the speed of rotation of the cutting roll is controlled relative to the speed of the web during the second part of the revolution in such manner that an optional distance is provided between succeeding cuts in the web.

The objects are also achieved by a machine for working an elongate web, preferably of plastic material, comprising a feeding device for feeding the web at a given speed through the machine and a cutting device for making cuts in the web, the cutting device comprising a rotary backing roll and a rotary cutting roll with a projecting cutting means, and the cutting roll being adapted to move, during a first part of its revolution, the cutting means into engagement with the backing roll to form the cuts and, during a second part of its revolution, define with the backing roll a gap through which the web moves essentially unimpededly, wherein a control means is associated with the cutting device and adapted to control the speed of rotation of the cutting roll relative to the speed of the web during the second part of the revolution for optional adjustment of the distance between succeeding cuts in the web.

The method and the machine according to the invention make it possible to form cuts in an essentially arbitrary spaced-apart relationship in a continuously supplied web of material. The peripheral speed of the cutting roll is suitably controlled to essentially correspond to the speed of the web during that part of the revolution in which the cutting means is engaged with the backing roll, while the cutting roll during the rest of the revolution is controlled at a peripheral speed which gives a desired distance between succeeding cuts in the web.

According to a preferred embodiment, the speed of rotation of the cutting roll is controlled in an infinitely variable manner relative to the speed of the web. Thus, it is possible to achieve any desired distance between succeeding cuts in the web. The speed of rotation of the cutting roll during the second part of the revolution can be increased for a reduced distance between succeeding cuts in the web and decreased for an increased distance between the cuts. The cutting roll is preferably driven by a first drive means with an infinitely variable number of revolutions, such as a servomotor.

It is also preferred for the backing roll to be given, with the aid of a second drive means, a peripheral speed which essentially corresponds to the speed of the web. As a result, undesirable tractive and elongation forces in the web are minimised.

According to another preferred embodiment, the second drive means comprises a drive roll which is made to abut against the circumferential surface of the backing roll. This enables easy adjustment of the distance between the backing roll and the cutting roll, for example for compensation for wear in the cutting means since the drive roll can be caused to follow the backing roll when displacing the same relative to the cutting roll. Moreover, a driven roll nip is formed between the drive roll and the backing roll and can be used for feeding the web of material.

According to one more preferred embodiment, a perforating device is controlled in conformity with the cutting roll to form perforation lines in the web. In this case, it is particularly preferred for the perforating device to comprise a perforation-forming cutting portion on the cutting means of the cutting roll. Thus, the perforation lines will automatically be in the desired position relative to the cuts, and besides the need for separate control of the perforating device is eliminated.

It is also preferred that cut-out material be removed from the web in a controlled fashion. According to an embodiment, a negative pressure is generated at least at one opening formed in the circumferential surface of the cutting roll for the purpose of retaining the cut-out material as the cutting means turns from the backing roll to a waste-receiving means, at which the cut-out material is delivered in a controlled fashion. Thanks to the cutout material thus being removed in direct connection with the cutting operation, the risk of uncontrolled spreading thereof is eliminated. The negative pressure is suitably generated in a portion of the circumferential surface of the cutting roll, said portion being enclosed by the cutting means.

Corresponding advantages also exist in preferred embodiments of the inventive machine.

According to another preferred embodiment, an element of a resilient material, preferably rubber material, is connected with said at least one opening in the circumferential surface of the cutting roll to form at least one mouth radially outside a cutting edge of the cutting means. The element is suitably adapted, when cooperating with the cutting roll, to be brought on a level with the cutting edge. This promotes removal of cut-out material from the web without any detrimental effect on the cutting operation. After cooperation with the backing roll, i.e. when the cutting means has cut out material from the web, the element in fact expands once more to its position radially outside the cutting edge. In this expansion, the peripheral speed of the element increases, whereby the cut-out material is torn loose from the web. The embodiment may be particularly advantageous in working of ductile materials, such as plastic materials.

BRIEF DESCRIPTION OF THE DRAWINGS

The invention and its advantages will now be described in more detail with reference to the accompanying schematic drawings, which by way of example illustrate currently preferred embodiments of the invention.

DESCRIPTION OF PREFERRED EMBODIMENTS

Figure 1A:
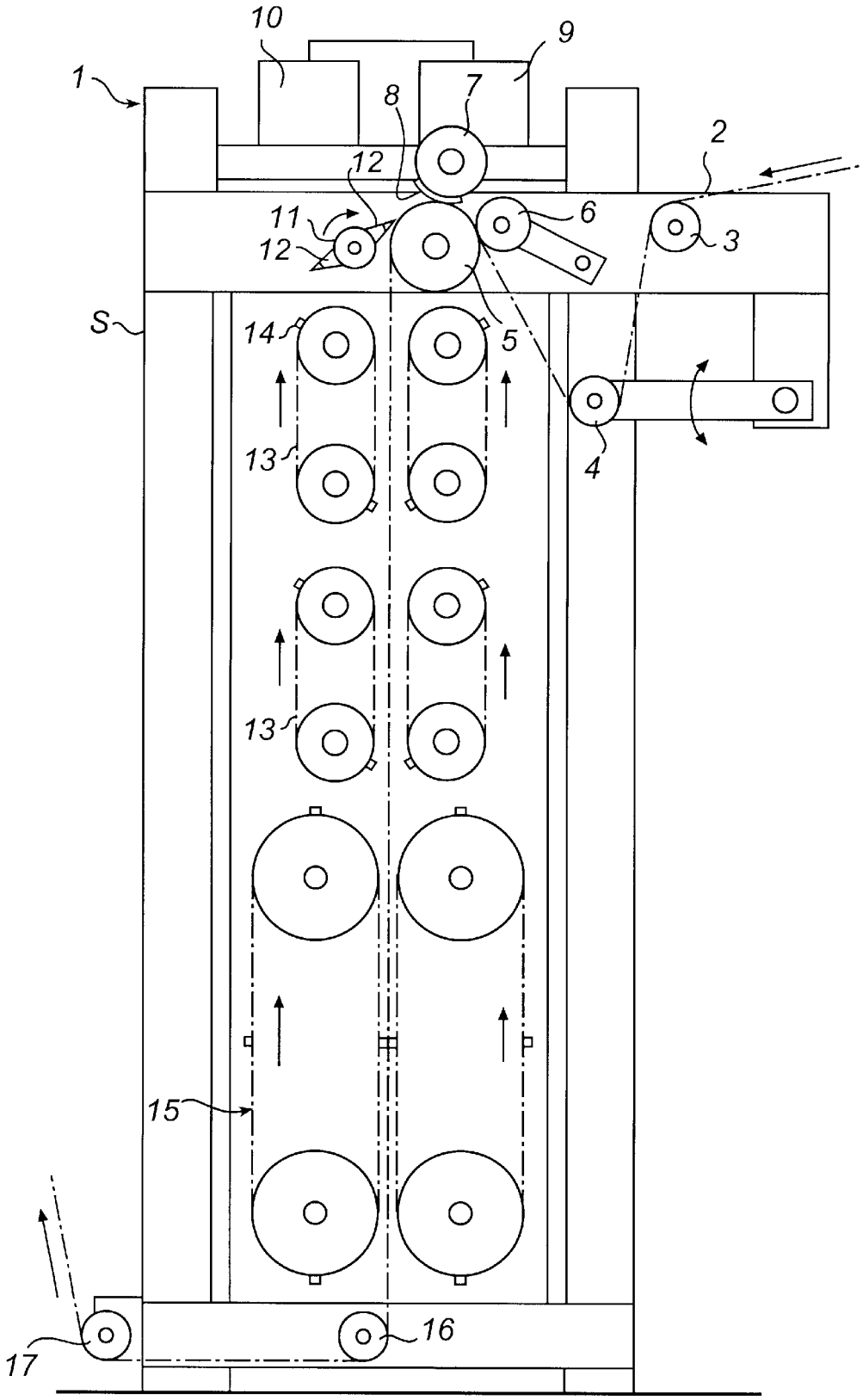
FIG. 1*a* is a side view of a first embodiment of the invention.

FIG. 1 shows an inventive bag-making machine 1 which is designed to produce, in a continuous web of material 2, bags with handles. The bag-making machine 1 has in prior-art manner a deflecting roll 3 and a pivotally mounted floating roll 4 for receiving the web 2. A roll nip with a backing roll 5, preferably made of steel, and a driven pinch roll 6, preferably made of a yieldable material, for instance a rubber material, is arranged in the upper portion of the bag-making machine 1. The backing roll 5 is arranged to be free rolling in the stand S and the pinch roll 6 is pivotally mounted in the stand S and biased against the backing roll 5 for driving the same and the web 2 extending through the roll nip. The web 2 is fed through the machine 1 at an essentially constant speed, typically about 120 m/min. The pinch roll 6 is connected to a drive means (not shown), for instance a servomotor, which causes the pinch roll 6 to rotate. A cutting roll 7 with a projecting cutting means 8 is also mounted in the stand S and driven to rotate with the aid of a separate drive means 9 having a variable number of revolutions, such as a servomotor. During rotation of the cutting roll 7 the cutting means 8 is caused to engage, while being controlled by a control unit 10, the web 2 passed over the backing roll 5 to form cuts in the web, as will be described in more detail below. In front of the backing roll 5, a perforating means 11 is mounted, which is rotatably arranged in the stand S and has two diametrically arranged, replaceable knives 12 which during rotation of the perforating means 11 are made to abut against the web 2 passed over the backing roll 5 to form transverse perforation lines. The cutting edge of each knife 12 is in prior-art manner provided with a toothing.

Two welding units 13 are arranged below the perforating means 11, which are of a known kind and each comprise transverse welding jaws 14 which are made to engage each other while clamping the web 2 moving downwards in the machine 1. The welding jaws 14 contain electric conductors (not shown), which by emission of heat produce weld lines in the vicinity of the perforation lines formed by the means 11. Below the welding units 13 a cooling path 15 is arranged, which is of a known type and will therefore not be described in more detail. The cooling path 15 is succeeded by two deflecting rolls 16, 17 by means of which the web 2 is made to leave the machine 1.

Figure 1B:
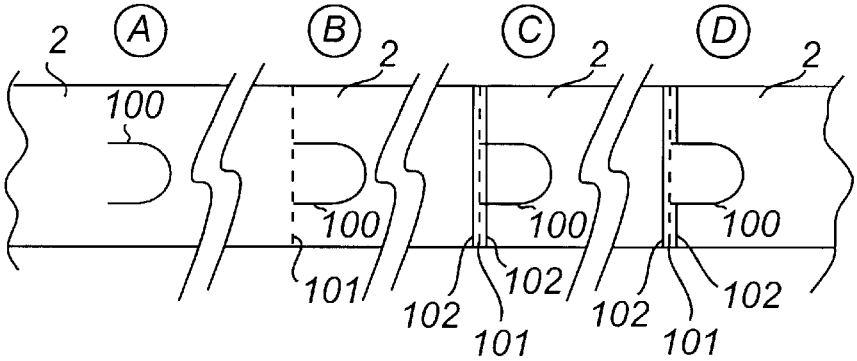
FIG. 1*b* is top plan view of a web of material to illustrate the working thereof in different parts of the machine in FIG. 1*a*.

FIG. 1*b* shows how the web 2 is worked while passing through the machine 1 according to the first embodiment. In position A, at the cutting roll 7, an essentially U-shaped cut 100 is formed in the web. In position B, at the perforating means 11, a transverse perforation line 101 is formed in connection with the cut 100 in the web. In position C, after the welding units 13, the web 2 is provided with two transverse weld lines 102 one on each side of the perforation line 101. In position D (not shown in more detail in FIG. 1*a*) cut-out material is removed, i.e. material which is defined by the cut 100 and the perforation line 101.

Figure 2:
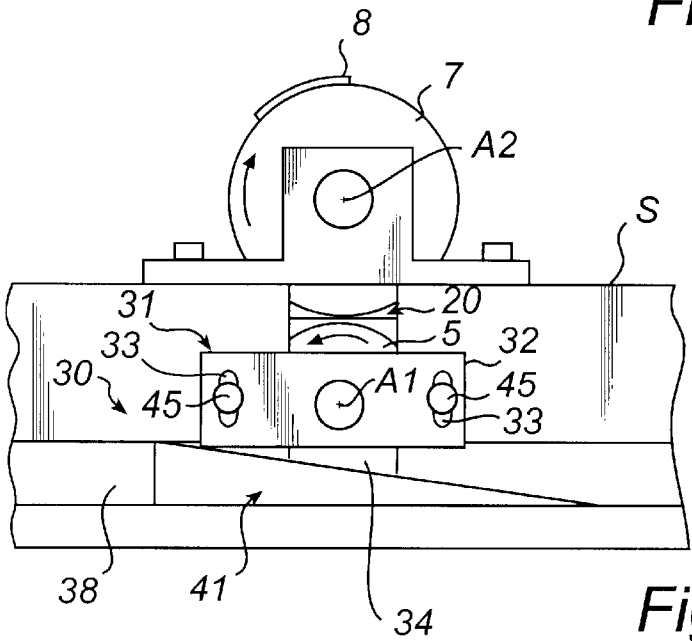
FIG. 2 is a side view of the cutting device of the machine in FIG. 1*a*.

FIG. 2 shows in more detail the cutting device which is formed of the cutting roll 7 and the backing roll 5. The backing roll 5 is fixed to the stand S for rotation on a first axis of rotation A1, the cutting roll 7 is fixed to the stand S for rotation about a second axis of rotation A2 which is essentially parallel with the first axis of rotation A1. The circumferential surfaces of the backing roll 5 and the cutting roll 7 are arranged at a distance from each other, so that a narrow gap 20 forms between them. The distance between the rolls 5, 7 essentially corresponds to the extent of the cutting means 8 in the radial direction. For a good cutting effect, the radial extent of the cutting means 8 should be slightly greater than the distance between the rolls 5, 7, which typically is about 4–5 mm. The rotating cutting roll 7 will thus during a first part of each revolution cause the cutting means 8 to engage the backing roll 5 to form the cuts 100 in the web 2, and during a remaining, second part of each revolution, the web 2 will move essentially unimpededly between the rolls 5, 7. The control unit 10 is adapted to give during the first part, with the aid of the drive means 9, the cutting roll 7 such a speed of rotation that the peripheral speed of the cutting means 8 corresponds to the speed of the web 2, i.e. the peripheral speed of the backing roll 5. The control unit 10 is also adapted to control, via the drive means 9, the duration of the second part of each revolution so that a desired distance is obtained between succeeding cuts 100 in the web. The speed of rotation of the cutting roll 7 is thus controlled relative to the speed of the web 2 during the second part of the revolution. The control unit 10 is also adapted to control the abutment of the perforating means 11 against the backing roll 5 and the abutment of the welding units 14 against the web 2 in conformity with the abutment of the cutting means 8 against the web, so that the perforation lines 101 which define each length of bag, and the weld lines 102 will be in a desired position relative to the cuts 100.

The backing roll 5 is connected with the stand S via a supporting unit 30 which allows adjustment of the position of the roll 5 relative to the cutting roll 7. Such adjustment can be necessary, for instance, when the cutting edge of the cutting means 8 has been worn down a fraction of a millimeter. The supporting unit 30, which is illustrated in FIGS. 2–3, is of a simple design and allows parallel displacement of the backing roll 5 with great accuracy.

Figure 3A:
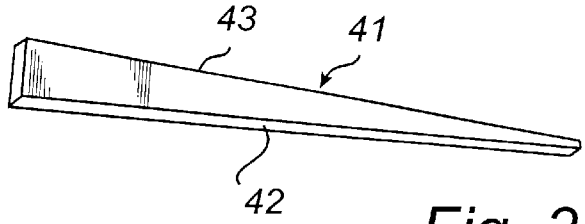
FIGS. 3*a*–3*c* are perspective views of parts included in the cutting device as shown in FIG. 2.
Figure 3B:
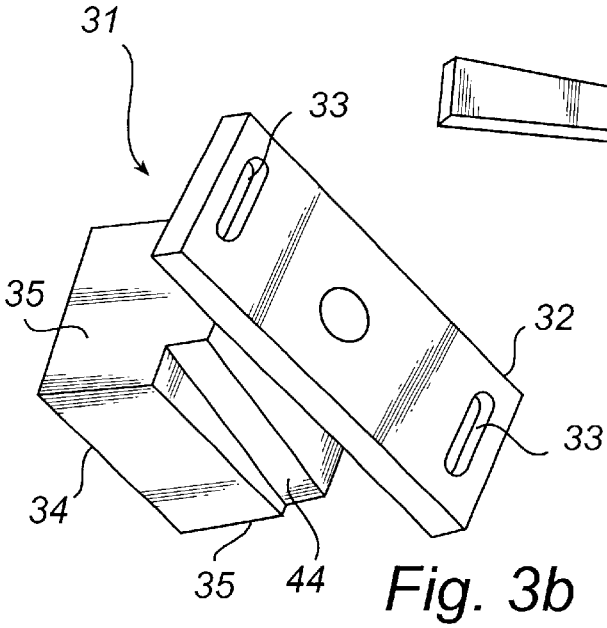
Figure 3C:
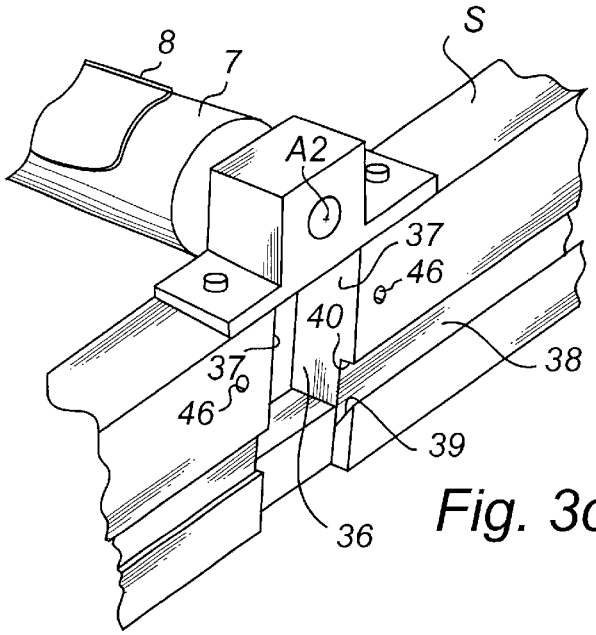

As is evident from FIGS. 2–3, the supporting unit 30 comprises a shaft holder 31, in which the backing roll 5 is mountable in a free-rolling manner. The shaft holder 31 (FIG. 3*b*) has a fixing plate 32 with elongate through fixing holes 33, and a guide block 34 with two plane-parallel sliding surfaces 35. A guide opening 36 (FIG. 3*c*) is formed in the stand S to receive the guide block 34 of the shaft holder 31. The guide opening 36 has two vertical, plane-parallel guide surfaces 37 whose relative distance corresponds to the distance between the sliding surfaces 35 of the guide block 34. The guide block 34 received in the opening 36 is thus slidingly displaceable in the vertical direction, more specifically radially towards the axis of rotation A2 of the cutting roll 7 (FIG. 3*c*). The stand S further comprises a groove 38 extending perpendicular to the guide surfaces 37 and having an angled bottom surface 39 and a horizontal top surface 40. A wedge element 41 (FIG. 3*a*) is slidingly received in the groove 38 and has a lower sliding surface 42 for cooperation with the bottom surface 39 of the groove 38, and an upper, inclined sliding surface 43 for cooperation with a correspondingly inclined lower sliding surface 44 of the guide block 34. A displacement of the wedge element 41 in the groove 38 thus causes the shaft holder 31, via the guide block 34, to be slidingly displaced in the vertical direction relative to the cutting roll 7. The shaft holder 31 is locked in position by means of fixing elements 45, which engage threaded openings 46 in the stand S via the holes 33 in the fixing plate 32.

A corresponding supporting unit (not shown) is arranged at the opposite end of the backing roll 5. Conveniently, a rule (not shown) is arranged along the groove 38 so that the roll 5 can be displaced in parallel with great accuracy.

A general advantage, which is not dependent on the type of supporting unit, is that the position of the backing roll 5 can be adjusted without any corresponding adjustment of the pinch roll 6, which is biased against the roll 5 independently of its position (FIG. 1).

Figure 4B:
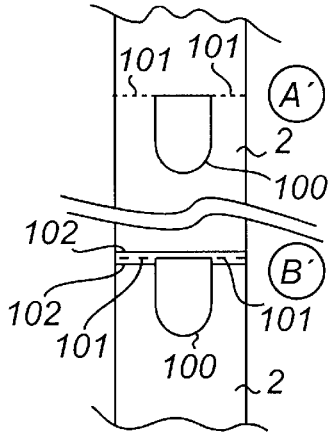
FIG. 4*b* is a top plan view of a web of material to illustrate the working thereof in different parts of the machine in FIG. 4*a*.
Figure 4A:
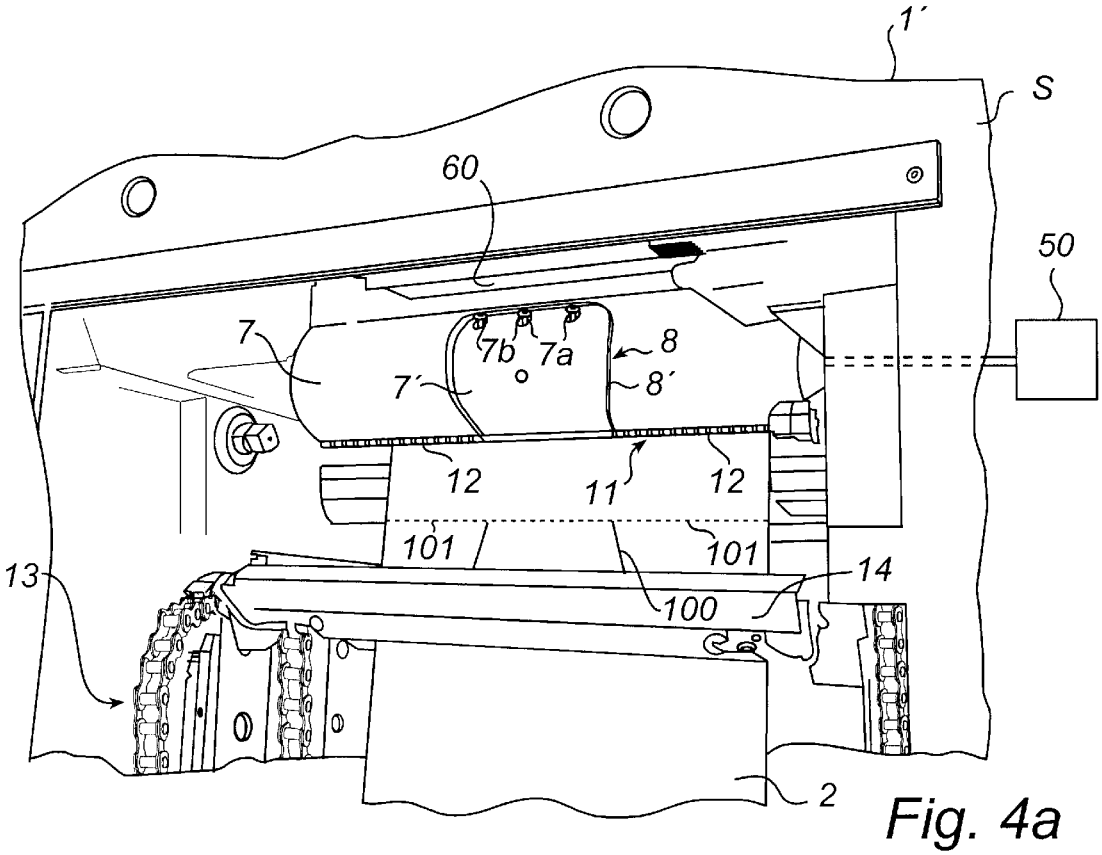
FIG. 4*a* is a perspective view of a second embodiment of the invention.

FIG. 4*a* shows a part of a bag-making machine 1' according to a second embodiment of the invention. The second embodiment differs from the first embodiment mainly by the design of the cutting roll 7. The following description focuses on relevant differences, and equivalent parts have been given equal reference numerals.

The modified cutting roll 7 is adapted to simultaneously form cuts 100 as well as perforation lines 101 in the web 2. The cutting means 8 comprises a continuous cut-forming cutting edge 8', which encloses a portion 7' of the circumferential surface of the roll 7, and two toothed perforation-forming cutting edges 12, which extend from the cut-forming cutting edge 8' in the longitudinal direction of the roll 7 to a respective roll end. The rear of the roll 7, which is not shown in FIG. 4, has no cutting means, and the rotation of the roll 7 is controlled similarly to the first embodiment, so that a desired distance is obtained between succeeding cuts 100, and perforation lines 101, in the web 2.

It should be pointed out that the second embodiment comprises a backing roll 5 and a pinch roll 6 like in the first embodiment, but that the backing roll 5 in this embodiment is positioned on a level with the cutting roll 7 and is therefore concealed by the same and the web 2 in FIG. 4*a*.

Simultaneously with the cuts 100 in the web 2, waste is formed, i.e. cut-out material. For safe removal of this waste, a number of openings 7*a* are formed in the surface portion 7' enclosed by the cutting edge 8' and are connected to a pressure control means 50, for instance a controllable pump or a fan, via a central duct (not shown) in the cutting roll 7. A tubular body 7*b* is connected to each opening 7*a* and has a funnel-like end projecting somewhat from the cutting edge 8', typically about 2–3 mm. The bodies 7 are suitably made of a resilient material, such as a rubber material. During operation of the bag-making machine 1' according to the second embodiment, the pressure control means 50 is actuated to generate, at the surface portion 7', a negative pressure which retains the waste during turning of the cutting means 8 from the backing roll (not shown) to a suction box 60, which removes the waste from the cutting roll 7 by suction. For optimal retaining of the waste, it has been found favourable to arrange the openings 7*a* adjacent to that part of the cutting means 8 which is the front part during rotation of the roll 7. When the surface portion 7' is on a level with the suction box 60, the pressure control means 50 can optionally be actuated to generate atmospheric pressure, or a pressure above atmospheric, at the surface portion 7', so that the removal of the waste is facilitated.

The tubular bodies 7*b* of resilient material are specifically arranged for working of ductile materials, such as plastic materials. In such materials, it may be difficult to remove the cut-out material from the web 2. When the cutting means 8 cooperates with the backing roll during rotation of the cutting roll 7, the tubular bodies 7*b* are compressed flush with the cutting edge 81 so as to expand once more to their normal extended position when they do not cooperate with the backing roll any longer. As the length of the bodies 7*b* increases, also their peripheral speed increases, and they tend to tear off, by friction, the cut-out material from the web 2.

According to an alternative embodiment (not shown), the bodies 7*b* are replaced with a pad of a resilient material having a high coefficient of friction relative to the web material, preferably a rubber material, such as neoprene. The pad is arranged in the surface portion 7' and projects somewhat from the cutting edge 8', typically about 2–3 mm. At least one through hole in the pad is aligned with the opening or openings 7*a* in the circumferential surface of the cutting roll 7. When the pad expands after the cutting operation, very safe removal of cut-out material from the web 2 is obtained, thanks to the large abutment/frictional surface of the pad against the web 2.

FIG. 4*b* shows how the web 2 is worked on its way through the machine 1' according to the second embodiment. In position A', at the cutting roll 7, a circumferential cut 100 in the web 2 and two connecting, transverse perforation lines 101 are formed. Moreover, the material cut out of the cut 100 is removed. In position B', after the welding units 14, the web 2 is formed with two transverse weld lines 102 one on each side of the perforation lines 100, to form a continuous web of plastic bags provided with handles.

It should be emphasised that the invention is not limited to the above embodiments and that several modifications are feasible within the scope of the appended claims. For example, the adjustable supporting unit 30 at the backing roll 5 can be replaced with some other suitable supporting mechanism, such as an eccentric. Furthermore, the feeding of the web can occur in some other manner, for instance via a roll nip which is arranged at a distance from the cutting roll 7 and the backing roll 5.

It should also be pointed out that the cutting device formed of the cutting roll 7 and the backing roll 5 can be arranged after the cooling path 15.

The method and machine according to the invention can be used for working of a single, double or multilayer film, for instance for producing a continuous web of plastic bags, plastic aprons etc.

What I claim and desire to secure by Letters Patent is:

1. A method for working an elongate web, preferably of plastic material, said web being fed at a given speed between a rotary backing roll and a rotary cutting roll which has a projecting cutting means, said cutting roll moving, during a first part of its revolution, said cutting means into engagement with said backing roll to form cuts in said web, and said cutting roll defining, during a second part of its revolution, with said backing roll a gap through which said web is moved essentially unimpededly, wherein the speed of rotation of said cutting roll is controlled relative to the speed of said web during said second part of the revolution in such manner that an optional distance is provided between succeeding cuts in said web.

2. A method as claimed in claim 1, wherein the speed of rotation of said cutting roll is controlled in an infinitely variable manner relative to the speed of said web.

3. A method as claimed in claim 1, wherein a perforating device is controlled in conformity with said cutting roll to form perforation lines in said web.

4. A method as claimed in claim 3, wherein said cutting means comprises a perforation-forming cutting portion which is moved into engagement with said backing roll and said web to form said perforation lines.

5. A method as claimed in claim 3 wherein said perforation device is positioned downstream from said cutting roll with respect to web travel such that perforation of the web occurs after cutting by said rotary cutting tool.

6. A method as claimed in claim 1, wherein cut-out material is removed from said web in a controlled manner.

7. A method as claimed in claim 6, wherein a negative pressure is generated at least at one opening, formed in the circumferential surface of said cutting roll, for retaining said cut-out material as said cutting means turns from said backing roll to a waste-receiving means, at which said cut-out material is supplied to said waste-receiving means in a controlled manner.

8. A method as claimed in claim 7, wherein said negative pressure is generated adjacent to said cutting means.

9. A method as claimed in claim 7, wherein said negative pressure is generated in a portion of said circumferential surface of said cutting roll, said portion being enclosed by said cutting means.

10. A method as claimed in claim 1, wherein said cutting roll is driven with the aid of a first drive means with an infinitely variable number of revolutions, preferably a servomotor.

11. A method as claimed in claim 1, wherein a peripheral speed which essentially corresponds to the speed of said web is imparted to said backing roll with the aid of a second drive means.

12. A method as claimed in claim 11, wherein said second drive means comprises a drive roll which is made to abut against said backing roll.

13. A method as claimed in claim 12, wherein said web extends through and is fed by a roll nip formed between said drive roll and said backing roll.

14. A method as claimed in claim 1, wherein the distance between said backing roll and said cutting roll is adjusted for optimal abutment of said cutting means against said web.

15. A method as claimed in claim 1, wherein a welding device is controlled in conformity with said cutting roll to form weld lines in said web.

16. A method as recited in claim 1 wherein said cutting roll has a speed of rotation during the first part of its revolution that corresponds to the speed of said web and a speed of rotation during the second part of the revolution which is increased relative to the speed of the web for a reduced distance between succeeding cuts in the web.

17. A method as claimed in claim 1 wherein said cutting roll has a speed of rotation during the first part of its revolution that corresponds to the speed of said web and a speed of rotation during the second part of the revolution which is decreased relative to the speed of the web for an increased distance between succeeding cuts in the web.

18. A machine for working an elongate web, preferably of plastic material, comprising a feeding device for feeding said web at a given speed through said machine and a cutting device for making cuts in said web, said cutting device comprising a rotary backing roll and a rotary cutting roll with a projecting cutting means, and said cutting roll being adapted to move, during a first part of its revolution, said cutting means into engagement with said backing roll to form said cuts and, during a second part of its revolution, define with said backing roll a gap through which said web moves essentially unimpededly, wherein a control means is associated with said cutting device and adapted to control the speed of rotation of said cutting roll relative to the speed of said web during said second part of the revolution for optional adjustment of the distance between succeeding cuts in said web.

19. A machine as claimed in claim 18, wherein said control means is adapted to control in an infinitely variable manner the speed of rotation of said cutting roll relative to the speed of said web.

20. A machine as claimed in claim 18, further comprising a perforating device for making perforation lines in said web, said control means being adapted to control said perforating device in conformity with said cutting device.

21. A machine as claimed in claim 20, wherein said perforating device comprises a perforation-forming cutting portion which is formed on said cutting means.

22. A machine as claimed in claim 18, further comprising a waste-removing device for controlled removal of cut-out material from said web.

23. A machine as claimed in claim 22, wherein said waste-removing device comprises at least one opening made in said circumferential surface of said cutting roll and a pressure control means, which is connected to said at least one opening and is actuatable to generate, at said circumferential surface, a negative pressure for retaining said cut-out material during turning of said cutting means from said backing roll to a waste-receiving means which is adapted to receive said cut-out material from said cutting roll.

24. A machine as claimed in claim 23, wherein an element of resilient material, preferably rubber material, is connected with said at least opening to form at least one mouth radially outside a cutting edge of said cutting means, said element being adapted, when cooperating with said backing roll, to be brought on a level with said cutting edge.

25. A machine as claimed in claim 24, wherein said element comprises at least one tubular body which is connected with said at least one opening.

26. A machine as claimed in claim 23, wherein said at least one opening is made in a portion of said circumferential surface of said cutting roll, said portion being enclosed by said cutting means.

27. A machine as claimed in claim 23, wherein said at least one opening is formed adjacent to said cutting means on said cutting roll, preferably adjacent to a part of said cutting means which is the front part in the direction of rotation of said cutting roll.

28. A machine as claimed in claim 18, wherein said control means is connected to a first drive means connected with said cutting roll and having an infinitely variable number of revolutions, preferably a servomotor.

29. A machine as claimed in claim 18, wherein a second drive means is adapted to impart to said backing roll a peripheral speed which essentially corresponds to the speed of said web.

30. A machine as claimed in claim 29, wherein said backing roll is arranged for free-rolling rotation, and wherein said second drive means comprises a drive roll which is made to abut against said backing roll.

31. A machine as claimed in claim 30, wherein said web extends through a roll nip between said drive roll and said backing roll.

32. A machine as claimed in claim 18, wherein said backing roll is fixed to a stand for free-rolling rotation on a first axis of rotation, and wherein said cutting roll is fixed in said stand for driven rotation on a second axis of rotation which is essentially parallel with said first axis of rotation, said backing roll being fixed to said stand via a supporting means which allows adjustment of the distance between said first and second axes of rotation.

33. A machine as claimed in claim 18, further comprising a welding device for making weld lines in said web, said control means being adapted to control said welding device in conformity with said cutting device.

34. A machine as claimed in claim 18 wherein said perforation device is positioned downstream from said cutting roll with respect to web travel.

35. A machine as claimed in claim 18 wherein said control means increases, relative to web speed, speed of rotation of the cutting roll during the second part of the revolution for a reduced distance in succeeding cuts in the web, and decreases the speed of rotation of the cutting roll during the second part of the revolution for an increased distance between succeeding cuts in the web.

* * * * *